US007326159B2

(12) United States Patent
Rong

(10) Patent No.: US 7,326,159 B2
(45) Date of Patent: Feb. 5, 2008

(54) FITNESS APPARATUS FOR ABDOMEN AND WAIST

(76) Inventor: Chou May Rong, P O Box 24-108, Taipei (TW)

( * ) Notice: Subject to any disclaimer, the term of this patent is extended or adjusted under 35 U.S.C. 154(b) by 72 days.

(21) Appl. No.: 11/242,418

(22) Filed: Oct. 3, 2005

(65) Prior Publication Data

US 2007/0087919 A1 Apr. 19, 2007

(51) Int. Cl.
*A63B 26/00* (2006.01)

(52) U.S. Cl. ..... 482/140; 482/142

(58) Field of Classification Search ..... 482/140, 482/907, 104, 91, 142
See application file for complete search history.

(56) References Cited

U.S. PATENT DOCUMENTS

| | | | | | |
|---|---|---|---|---|---|
| 3,835,844 | A * | 9/1974 | Lang | 601/49 |
| 5,100,131 | A * | 3/1992 | Fong | 482/112 |
| 5,393,286 | A * | 2/1995 | Cheng | 482/130 |
| 5,573,485 | A * | 11/1996 | Geschwender | 482/112 |
| 5,833,590 | A * | 11/1998 | Chiu et al. | 482/142 |
| 5,931,769 | A * | 8/1999 | Nunez | 482/142 |
| D424,142 | S * | 5/2000 | McBride et al. | D21/690 |
| 6,231,489 | B1 * | 5/2001 | McBride et al. | 482/142 |
| 6,258,016 | B1 * | 7/2001 | Kuo | 482/142 |
| 6,283,900 | B1 * | 9/2001 | Tornabene | 482/122 |
| 6,312,401 | B1 * | 11/2001 | Smith | 602/32 |
| 6,544,151 | B2 * | 4/2003 | Tornabene | 482/122 |
| 6,569,069 | B1 * | 5/2003 | Linares | 482/148 |
| 6,656,095 | B2 * | 12/2003 | Fernandez | 482/142 |
| 7,125,366 | B1 * | 10/2006 | Yeh | 482/140 |
| 2004/0053757 | A1 * | 3/2004 | Chung | 482/140 |
| 2005/0075224 | A1 * | 4/2005 | Lin | 482/130 |
| 2005/0075225 | A1 * | 4/2005 | Shin | 482/130 |
| 2005/0181916 | A1 * | 8/2005 | Frost et al. | 482/140 |
| 2006/0068979 | A1 * | 3/2006 | Hsieh | 482/140 |
| 2006/0100073 | A1 * | 5/2006 | Ho | 482/140 |
| 2006/0205575 | A1 * | 9/2006 | Ho | 482/140 |

* cited by examiner

*Primary Examiner*—Lori Amerson

(57) ABSTRACT

An improved fitness apparatus for abdomen and waist includes a base rod bent forward and having a handle on both sides of the base rod, a main rod disposed perpendicularly upward at the middle section of the base rod, a headrest rod having a head rest inserted at the top of the main rod and being capable of adjusting its length. The apparatus further includes an upper rod stand, an arc back rod curved forward and disposed between the upper rod stand and both ends of the base rod, a back cushion or massage rod curvedly installed and pivotally coupled between the back rod, an arc rod having the same curvature disposed backward between the upper rod stand and both ends of the base rod, a support rod, an elastic member installed between the support rod and the main rod.

1 Claim, 10 Drawing Sheets

FITNESS APPARATUS FOR ABDOMEN AND WAIST

BACKGROUND OF THE INVENTION

1. Field of the Invention

The present invention relates to an improved fitness apparatus for abdomen and waist, and more particularly to a fitness apparatus that overcomes the prior art fitness apparatus for abdomen and waist, and the improved fitness apparatus includes a base rod bent forward and having a handle on both sides of the base rod, a main rod disposed perpendicularly upward at the middle section of the base rod, a headrest rod having a headrest inserted at the top of the main rod and being capable of adjusting its length, an upper rod stand disposed transversally at the top of the main rod and parallel to the base rod, an arc back rod curved forward and disposed between the upper rod stand and both ends of the base rod, a back cushion or a massage rod curvedly and pivotally installed between the back rod, an arc rod having the same curvature disposed backward between the upper rod stand and both ends of the base rod, a support rod rotated backward and pivotally connected to the middle section of the main rod, an elastic member installed between the support rod and the main rod, so that a user can sit between the two handles and lean the back against the massage rod or the back cushion, and both legs are placed on the floor for the support. Both hands pull the handles and the back presses against the back cushion or massage rod to drive the curved edge of the arc rod to rotate backward along the floor, and the main rod pushes the support rod and pulls the elastic member, and the arc back cushion or massage rod supports the user's waist and back by the principle of ergonomics, so as to life the users up easily and prevent the user from being hit, injured, or slid down. When the user stops applying force, the center of gravity of the user's body will press the back cushion or the massage rod, and the fitness apparatus will resume its original position by the resilience of the elastic member. Therefore, the application of force can drive the fitness apparatus for the exercises of the user's waist, abdomen, and legs. The invention comes with a reduced overall volume, saves transportation and storage space, and avoids any protrusions that may hurt the users as well as others.

2. Description of the Related Art

Since people pays more attention to exercises and fitness in these days and our living standard is improved constantly, fitness apparatuses become very popular nowadays. There are various different kinds of fitness apparatuses, but the fitness apparatus for training abdomen and waist usually incurs a high manufacturing cost, a large volume, and a low adaptability. Therefore, a prior art disclosed in U.S. Pat. No. 6,283,900 and shown in FIG. 1 was introduced, but the back cushion 20 of such patent is flat, and the flat back cushion 20 does not comply with the principle of ergonomics, so that when a user applies a force, the bottom edge of the back cushion 20 will press on the user's hip and lift the user's back, and the user's hip may be hit or injured. Due to the factor of gravity, the user may be slid down easily along the flat back cushion 20. Further, the handles 100 on both ends of such patent are extended outward, and thus it will occupy much storage space or cause injuries to users or others. These shortcomings require improvements.

SUMMARY OF THE INVENTION

In view of the shortcomings of the prior art, the inventor of the present invention based on years of experience in the related industry to perform extensive researches and experiments, and finally invented an improved fitness apparatus for abdomen and waist in accordance with the present invention.

Therefore, it is a primary objective of the present invention to provide an improved fitness apparatus for abdomen and waist that includes a base rod bent forward and having a handle on both sides of the base rod, a main rod disposed perpendicularly upward at the middle section of the base rod, a headrest rod having a head rest inserted at the top of the main rod and being capable of adjusting its length, an upper rod stand disposed transversally at the top of the main rod and parallel to the base rod, an arc back rod curved forward and disposed between the upper rod stand and both ends of the base rod, a back cushion or massage rod curvedly and pivotally installed between the back rod, an arc rod having the same curvature disposed backward between the upper rod stand and both ends of the base rod, a support rod rotated backward and pivotally connected to the middle section of the main rod, an elastic member installed between the support rod and the main rod, so that when the fitness apparatus is used, the arc back cushion or massage rod supports the waist and back of the user by the principle of ergonomics and lifts the user up easily, and thus prevents collisions or injuries and also prevents the user's body from sliding down.

Another objective of the present invention is to provide an improved fitness apparatus for abdomen and waist that comes with a handle bent forward to reduce the overall volume, and thus reducing the storage and transportation space, and the invention also can prevent injuries to users and others.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
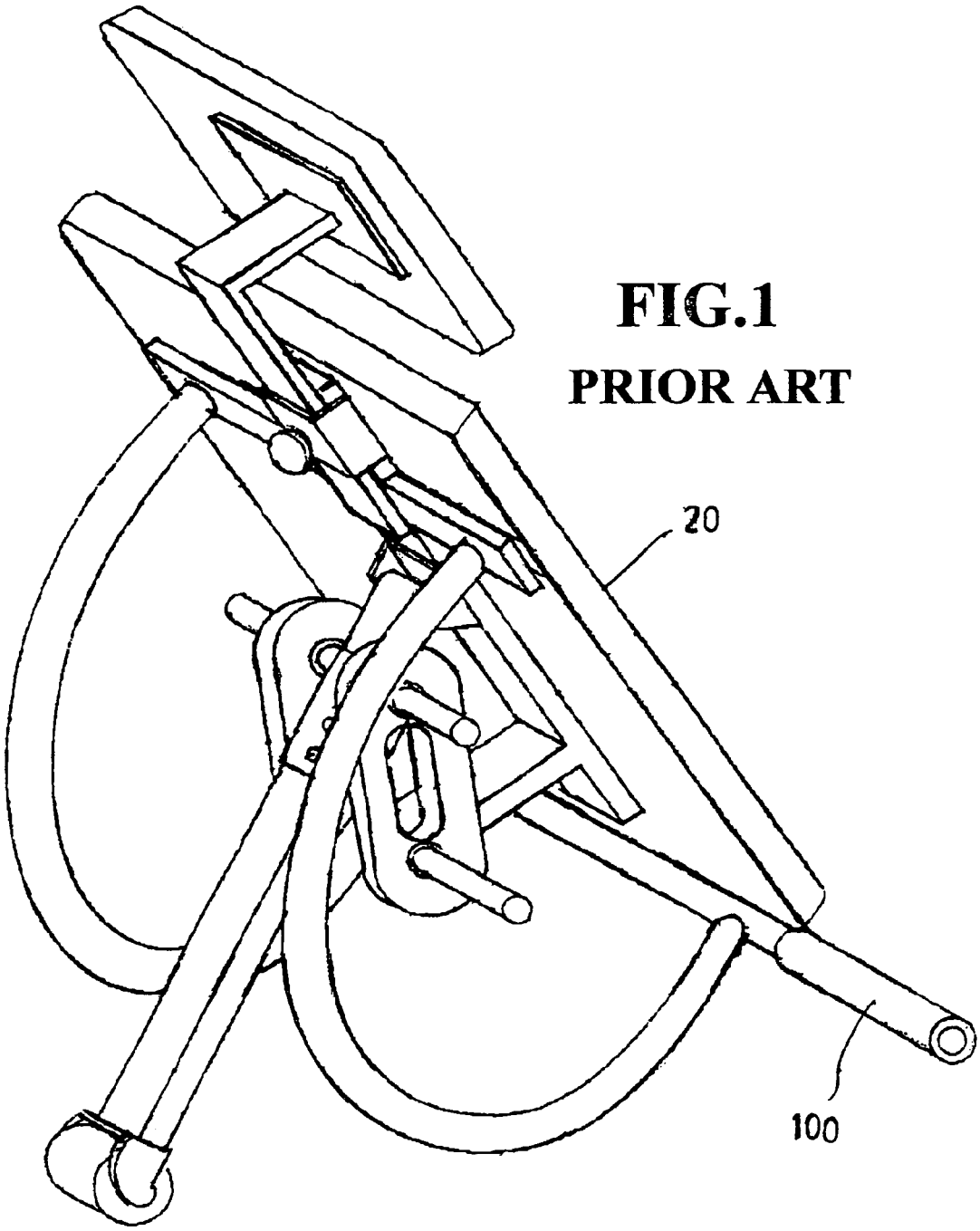
FIG.1 PRIOR ART
FIG. 1 is a perspective view of a prior art.
Figure 2:
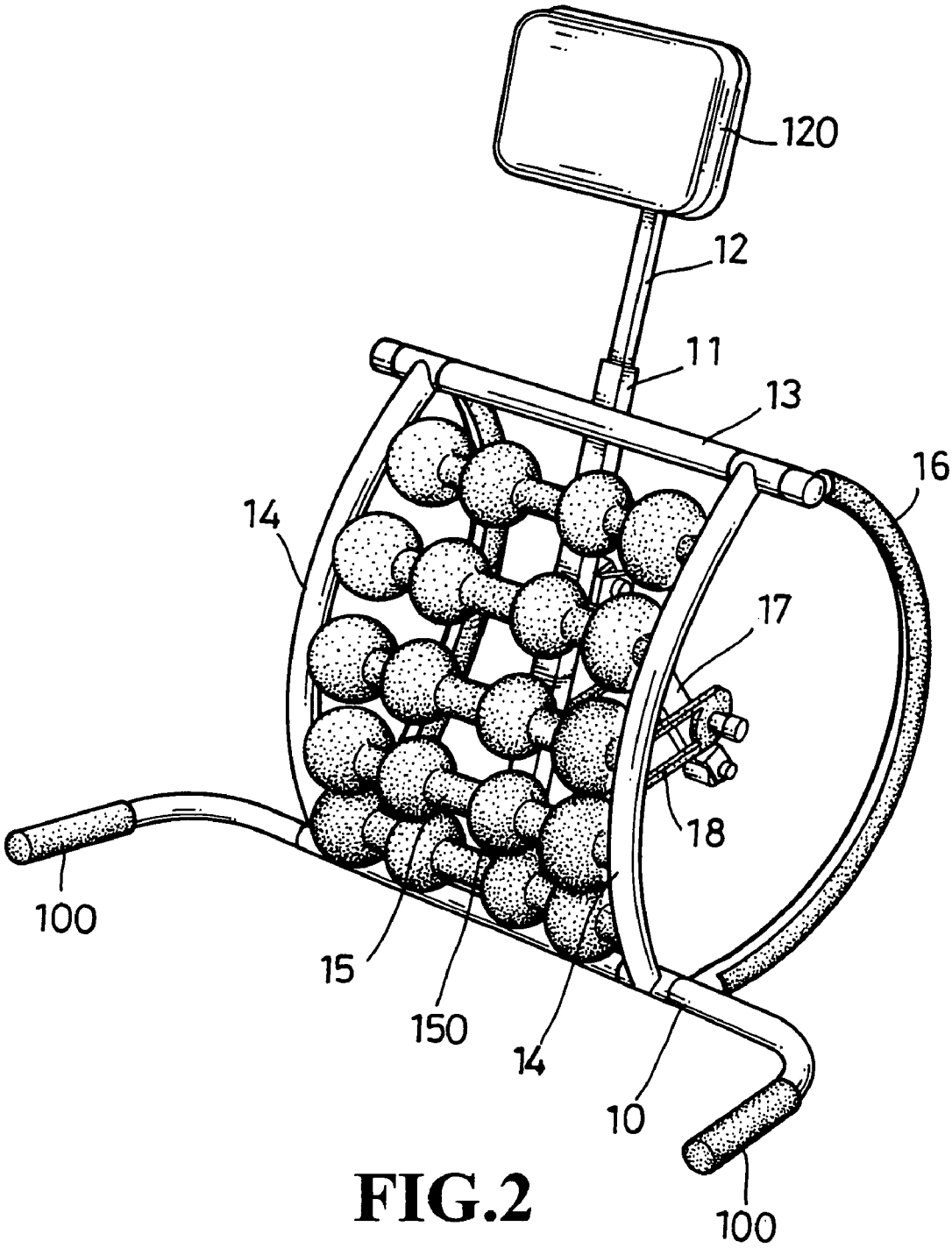
FIG. 2 is a perspective view of a first preferred embodiment of the present invention.
Figure 3:
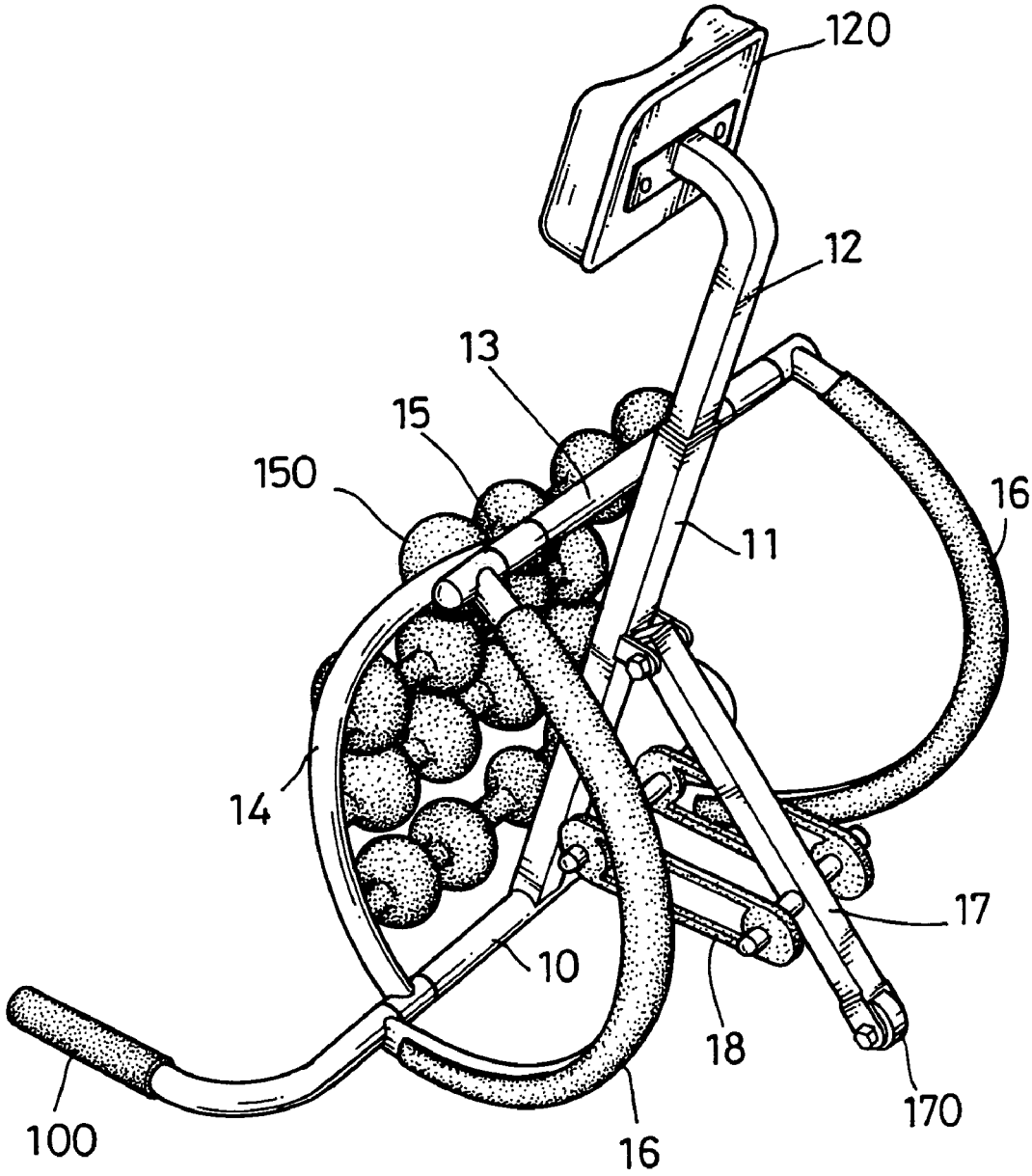
FIG. 3 is another perspective view of a first preferred embodiment of the present invention.
Figure 4:
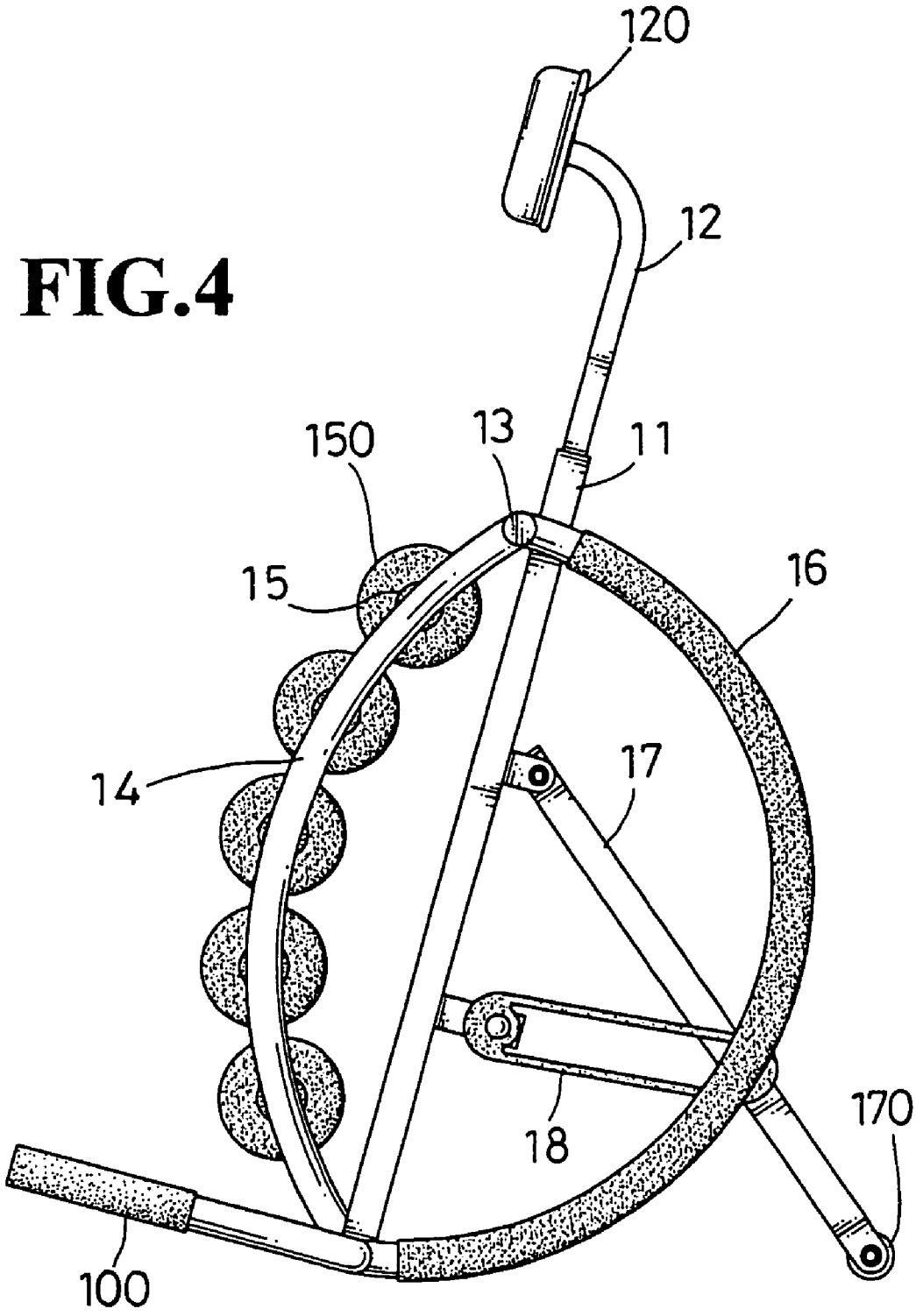
FIG. 4 is a side view of perspective view of a first preferred embodiment of the present invention.
Figure 5:
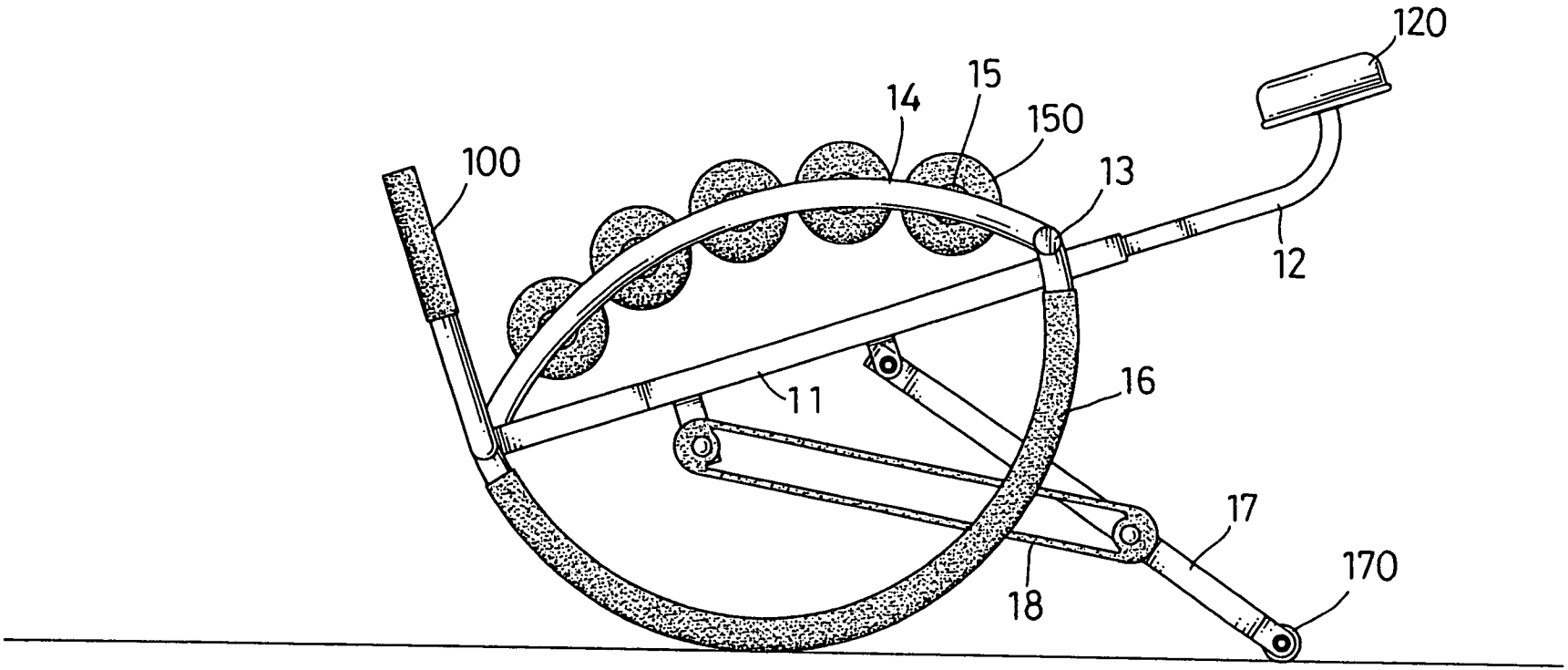
FIG. 5 is a side view of a main rod and a support rod being spread open according to a first preferred embodiment of the present invention.
Figure 6:
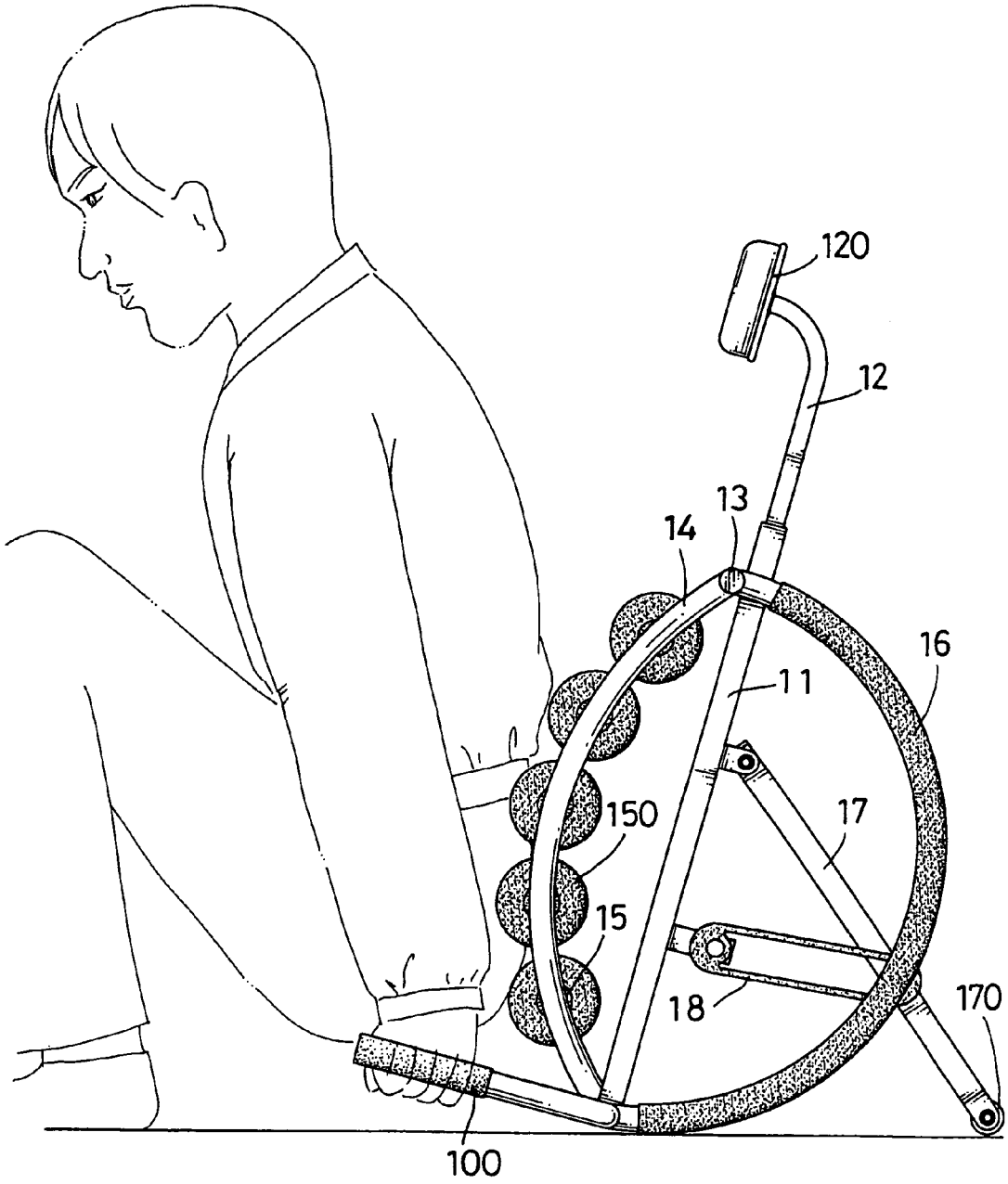
FIG. 6 is a schematic side view of a first preferred embodiment of the present invention.
Figure 7:
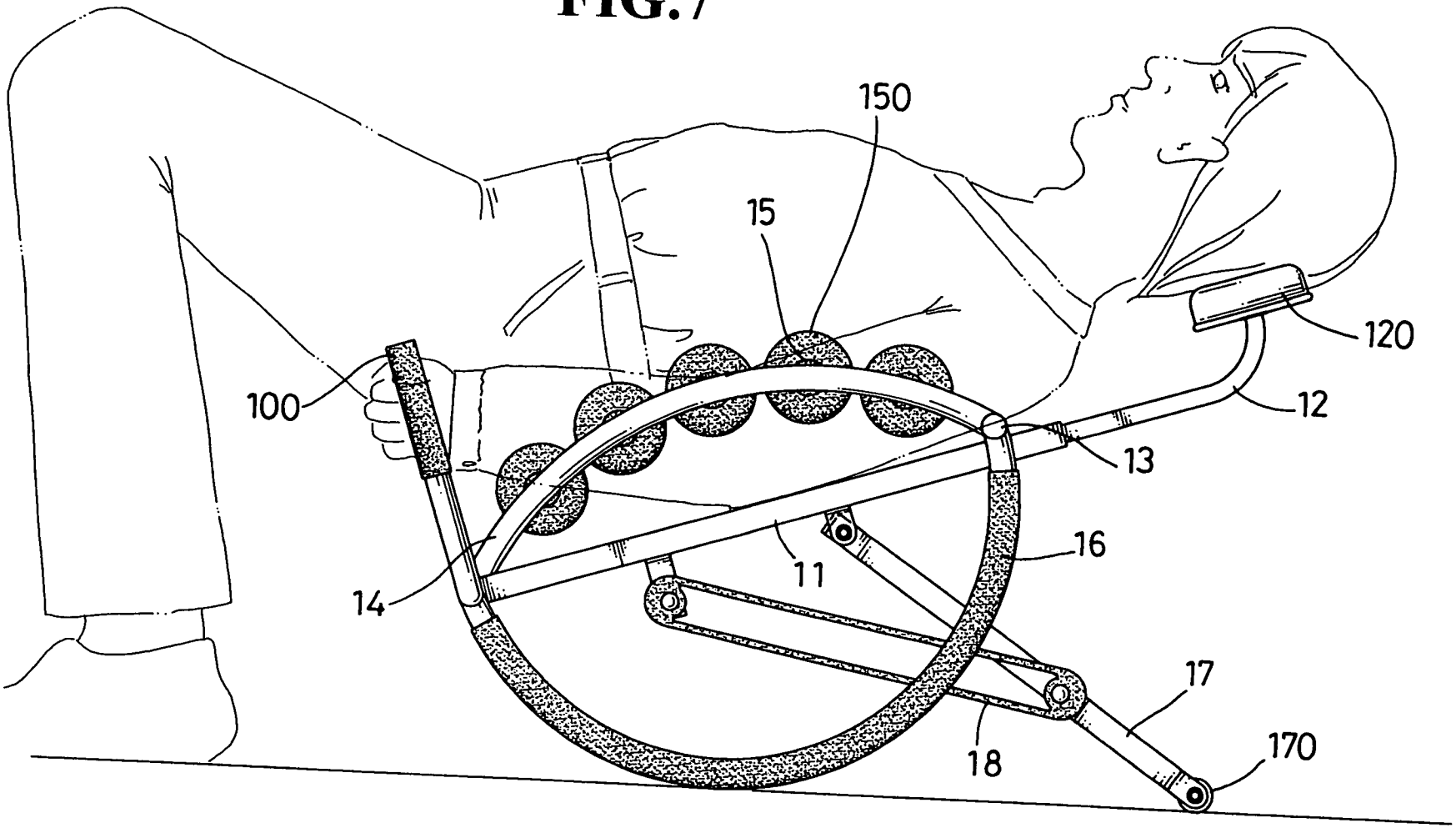
FIG. 7 is a schematic side view of a second preferred embodiment of the present invention.
Figure 8:
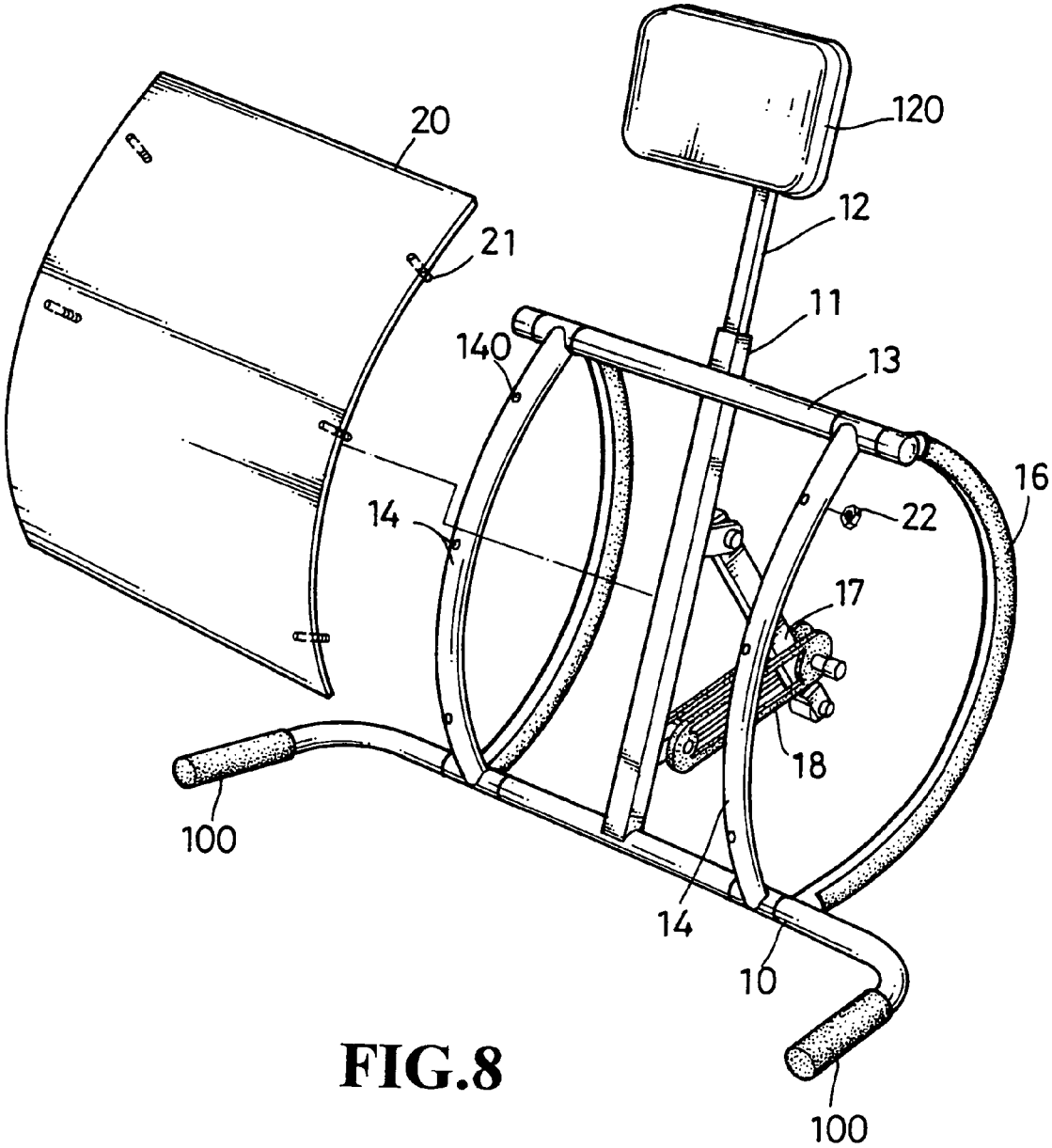
FIG. 8 is an exploded view of a second preferred embodiment of the present invention.
Figure 9:
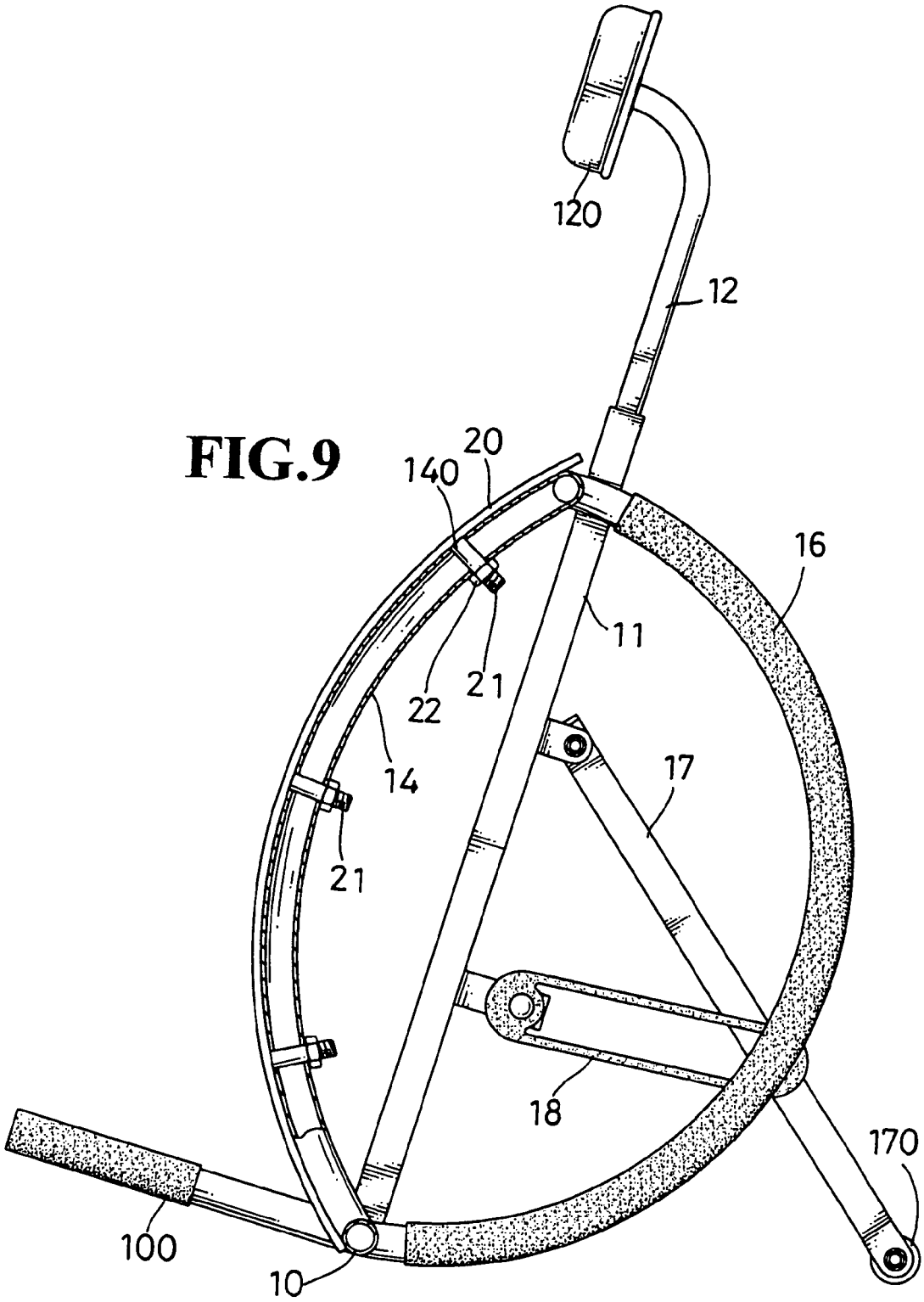
FIG. 9 is a cross-sectional view of a section of a second preferred embodiment of the present invention.
Figure 10:
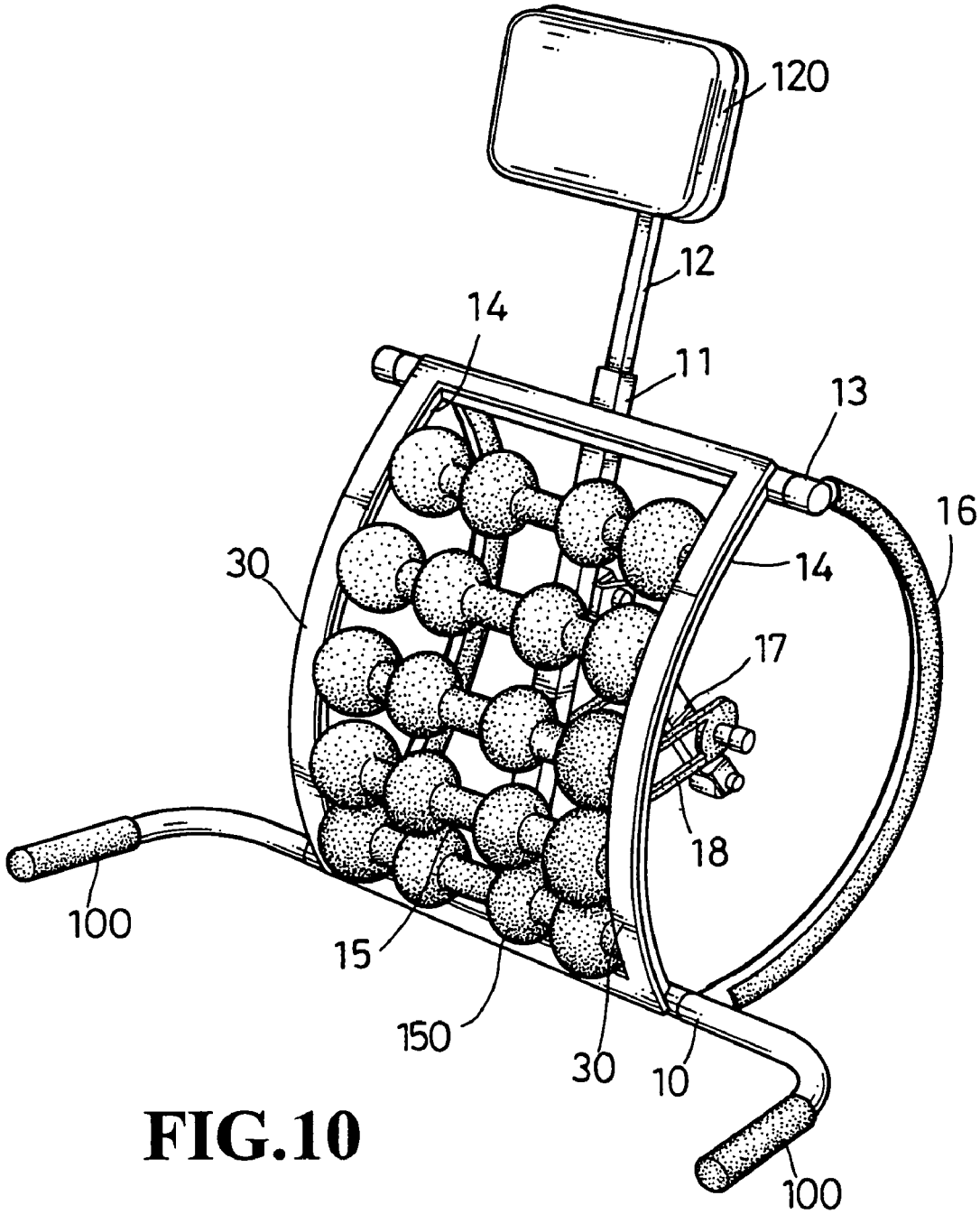
FIG. 10 is a perspective view of a third preferred embodiment of the present invention.

Referring to the figures, the present invention comprises a base rod 10, a main rod 11, a headrest rod 12, an upper rod stand 13, a back rod 14, a massage rod 15, a curved rod 16, a support rod 17, and an elastic member 18. The base rod 10 includes a handle 100 dipsosed separately on both ends of the base rod 10 and bent forward, and the base rod 10 includes the main rod 11 disposed perpendicualry at the middle section of the base rod 10, and the main rod 11 includes a headrest 120 inserted at the top of the main rod 11 for adjusting the length of the headrest rod 12, and the main rod 11 includes the upper rod stand 13 transversally disposed at the top of the main rod 11 and parallel to the base rod 10. The back rod 14 is disposed between the upper rod stand 13 and both ends of the base rod 10 and curved forward, and a plurality of massage rods 15 is pivotally coupled between the back rods 14. The massage rod 15 includes a plurality of massage beads 150 directly installed onto installing holes 140 of the back rod 14 as shown in FIGS. 8 and 9 and a screw nut 22 is used to secure an installing rod 21 onto a curved back cushion 20. The curved rod 16 is disposed between the upper rod stand 13 and the base rod 10, and bent backward with the same curvature, and the middle section of the main rod 11 is pivotally coupled to a support rod 17 capable of being swung backward. The swinging end of the support rod 17 includes a roller 170, and the support rod 17 includes the elastic member 18 disposed between the roller 170 and the main rods 11 and proximate to the roller 170, The elastic member 18 could be a rubber ring, a rubber band, or a spring having extendable and resilient properties.

In the practical operation of the present invention, a user can adjust the headrest rod 12 first and to fix the headrest rod 12 at an appropriate length to fit the height of the user, and the elasticity of the elastic member 18 can be changed to fit different levels of exercises for the user. The user sits on the floor between both handles 100 and leans his/her back against the back cushion 20 or the massage rods 15. Both legs are placed on the floor for support, and both hands grip the handles 100 and pull the handles 100 upward. In the meantime, the user's back presses on the back cushion 20 or the massage rods 15. The users' legs step on the floor to apply a pulling force, so that the curved edge of the curved rod 16 is driven to rotate backward along the floor, and the main rod 11 is driven to press the support rod 17 to be extended outward, and the elastic member 18 is pulled. By that time, the ergonomic curved back cushion 20 or massage rods 15 supports the user's waist and back and lifts the user up, so as to prevent the back cushion 20 or massage rods 15 from hitting or injuring the user, and also prevents the user from sliding down. When the user stops applying force, the center of gravity of the user's body will press on the back cushion 20 or the massage rods 15, and the resilience of the elastic member 18 resumes the fitness apparatus to its original position. Such arrangement allows the user to do exercises repeatedly, and the plurality of massage beads 150 installed on the massage rod 15 can massage the user's back.

Since the handles 100 of the present invention are bent forward, therefore the protruded section on both sides can be reduced, and the overall volume can be decreased. Such arrangement can reduce the storage and transportation space of the fitness apparatus, and also prevent injuries to users or others. The present invention can add a decorative board 30 to the back rod 14, base rod 10, and upper rod stand 13 to make the fitness apparatus look more artistic.

While the invention has been described by means of specific embodiments, numerous modifications and variations could be made thereto by those skilled in the art without departing from the scope and spirit of the invention set forth in the claims.

What is claimed is:

1. An improved fitness apparatus for abdomen and waist, comprising a base rod, a main rod, a headrest rod, an upper rod stand, a back rod, a massage rod, a curved rod, a support rod and an elastic member, wherein said base rod includes a handle separately disposed on both ends of said base rod and bent forward, and a main rod is disposed perpendicularly at the middle section of said base rod, and said main rod includes said headrest rod being inserted at the top of said main rod and capable of adjusting the length of said headrest rod, and said back rod is curved forward and disposed between said upper rod stand and both ends of said base rod, and a plurality of massage rods is transversally curved and pivotally coupled between said back rods to form a curved backrest, and said curved rod is disposed between said upper rod stand and said base rod and bent backward with the same curvature, and said support rod is swung backward and pivotally coupled to the middle section of said main rod, and said support rod includes a roller disposed at the swinging end of said support rod and said elastic member disposed between said roller and the bottom of said main rod and proximate to said roller, wherein said massage rod includes a plurality of massage beads thereon.

* * * * *